US006384799B1

(12) United States Patent
Otomo et al.

(10) Patent No.: US 6,384,799 B1
(45) **Date of Patent: *May 7, 2002**

(54) ANTENNA HAVING A HELICAL ANTENNA ELEMENT EXTENDING ALONG A CYLINDRICAL FLEXIBLE SUBSTRATE

(75) Inventors: Shinichi Otomo; Kazuo Minegishi, both of Sendai (JP)

(73) Assignee: Tokin Corporation, Miyagi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/354,010

(22) Filed: Jul. 15, 1999

(51) Int. Cl.[7] ..... H01Q 1/38
(52) U.S. Cl. ..... 343/895; 343/702
(58) Field of Search ..... 343/895, 702, 343/897

(56) References Cited

U.S. PATENT DOCUMENTS

| | | | | |
|---|---|---|---|---|
| 3,573,840 A | | 4/1971 | Gouillou et al. | 343/895 |
| 4,945,363 A | | 7/1990 | Hoffman | 343/895 |
| 5,134,422 A | * | 7/1992 | Auriol | 343/895 |
| 5,198,831 A | | 3/1993 | Burrell et al. | 343/895 |
| 5,943,027 A | * | 8/1999 | Thill et al. | 343/895 |

FOREIGN PATENT DOCUMENTS

| | | |
|---|---|---|
| GB | 2 280 789 A | 2/1995 |
| GB | 2 322 236 A | 8/1998 |
| JP | 2-36505 | 2/1990 |
| JP | 3-74906 | 3/1991 |
| JP | 5-243829 | 9/1993 |
| JP | 6-11327 | 2/1994 |
| JP | 7-99404 | 4/1995 |
| JP | 7-176929 | 7/1995 |
| JP | 8-84017 | 3/1996 |
| JP | 6-97712 | 4/1999 |
| WO | WO 97/49141 | 12/1997 |

* cited by examiner

*Primary Examiner*—Don Wong
*Assistant Examiner*—James Clinger
(74) *Attorney, Agent, or Firm*—Frishauf, Holtz, Goodman, Langer & Chick, P.C.

(57) ABSTRACT

In an antenna for use in a mobile communication apparatus and having a helical antenna element (40) of a helical shape, the helical antenna element is mounted on a flexible substrate (1) rounded to form a cylindrical shape. The helical antenna element has a plurality of oblique conductive patterns (4) extending along the flexible substrate and electrically connected to one another at their terminal ends to form the helical shape. The oblique conductive patterns have a similar pitch therebetween.

5 Claims, 3 Drawing Sheets

ANTENNA HAVING A HELICAL ANTENNA ELEMENT EXTENDING ALONG A CYLINDRICAL FLEXIBLE SUBSTRATE

BACKGROUND OF THE INVENTION

This invention relates to an antenna for use in a mobile communication apparatus such as a mobile telephone set and, in particular, to an antenna in which an antenna base element arranged in an antenna top has a flexible structure.

As conventional antenna of the type, use is typically made of a helical antenna and a separate antenna comprising the helical antenna. For example, the helical antenna is manufactured in the following manner. At first, an antenna base element is prepared which has one-end portion provided with a helical coil guide made of a nonconductive material and the other-end portion coupled to a sleeve made of a conductive material. The sleeve has a sleeve-helical coupling portion and a flange portion and serves as a feeding portion. Then, a helical antenna element having an antenna function is screwed onto the helical coil guide and is brought into contact with the flange portion of the sleeve so as to be electrically fed from the sleeve. Finally, in order to protect the helical antenna element and to improve a commercial value in design, an antenna top is molded to cover the one-end portion of the antenna base element and the flange portion of the sleeve.

By the use of the above-mentioned antenna base element, the separate antenna is manufactured. Specifically, a whip antenna element is mechanically fixed to the other-end portion of the antenna base element before the above-mentioned antenna top is molded. More in detail, the whip antenna element is supported at its one end by an insulator forming a body of the antenna base element and extending through an inner bore of the sleeve. The helical antenna element is screwed onto the helical coil guide and is brought into contact with the flange portion of the sleeve so as to be electrically fed from the sleeve. Thereafter, the antenna top is molded to cover the one-end portion of the antenna base element and the flange portion. Subsequently, the whip antenna element is covered with a face tube for protection and smart appearance. Around the face tube, a holder is attached so as to be slidable on the outer peripheral surface of the face tube. A stopper is attached to the whip antenna element at the other end thereof opposite to the one end fixed to the insulator.

Upon manufacture of the helical antenna or the separate antenna described above, it is required to screw the helical antenna element of a predetermined diameter onto the helical coil guide. During any operation in the overall manufacturing process up to the formation of the antenna top, the helical antenna element may be deformed or displaced under some external force. In this event, antenna characteristics will be adversely affected.

In order to avoid the above-mentioned situation, the size of each of the helical antenna element and the helical coil guide is accurately selected so that the helical antenna element is exactly fitted to the helical coil guide to be prevented from easy movement out of its proper position.

However, in order to fit the helical antenna element of such a size accurately selected as described above to the helical coil guide, delicate and skillful work is required. In addition, it is difficult to completely prevent the deformation or the displacement of the helical antenna element. As a result, the production cost is inevitably increased in order to provide good products which are excellent in antenna characteristics and high in reliability.

For example, existing techniques related to the helical antenna and the separate antenna are disclosed in Japanese Unexamined Patent Publications (JP-A) Nos. 5-243829 (243829/1993) and 7-99404 (99404/1995).

SUMMARY OF THE INVENTION

It is an object of the present invention to provide an antenna which can be easily and economically manufactured and highly reliable without deformation and displacement during manufacture.

Other objects of the present invention will become clear as the description proceeds.

An antenna to which the present invention is applicable is for use in a mobile communication apparatus and comprises a helical antenna element of a helical shape and a flexible substrate rounded to form a cylindrical shape. The helical antenna element comprises a plurality of oblique conductive patterns extending along the flexible substrate and electrically connected to one another at their terminal ends to form the helical shape. The oblique conductive patterns have a pitch similar pitch therebetween.

It may be arranged that the flexible substrate has end portions facing to each other in the cylindrical shape, each of the oblique conductive patterns extending between the end portions.

It may be arranged that the oblique conductive patterns are parallel to one another.

It may be arranged that the oblique conductive patterns have a width similar to one another.

It may be arranged that the antenna further comprises an antenna top containing the flexible substrate of the cylindrical shape.

It may be arranged that the antenna further comprises a conductive sleeve fitted as a feeding portion to the flexible substrate of the cylindrical shape.

It may be arranged that the flexible substrate has a feeding contact formed on one of two remaining sides thereof to be electrically connected to the sleeve.

It may be arranged that the helical antenna element further comprises a plurality of contact pin terminals connected to first ends of the oblique conductive patterns and a plurality of contact receptacle terminals connected to second ends of the oblique conductive patterns, the contact pin terminals and the contact receptacle terminals being connected to each other in one-to-one correspondence.

DESCRIPTION OF THE PREFERRED EMBODIMENT

Figure 1:
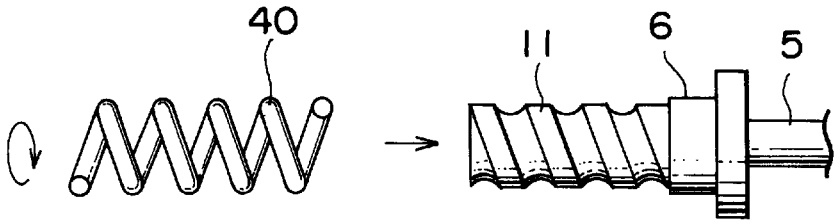
FIG. 1 PRIOR ART
FIG. 1 is a side view of a characteristic part of a conventional helical antenna.
Figure 2:
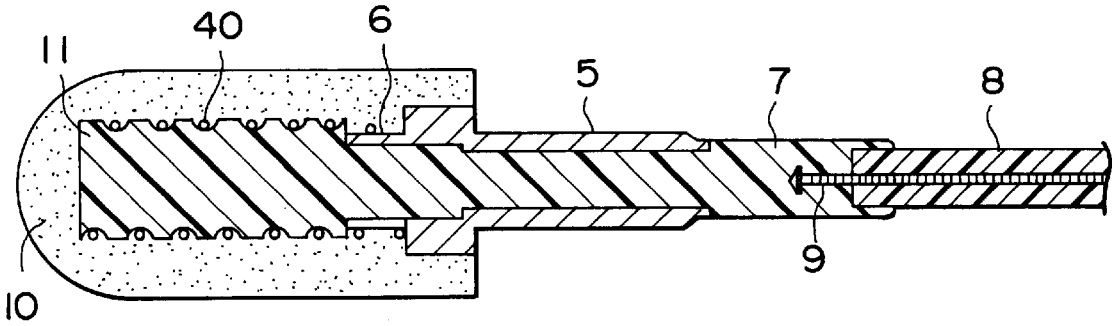
FIG. 2 PRIOR ART
FIG. 2 is a side sectional view of a conventional separate antenna using the helical antenna illustrated in FIG. 1.

In order to facilitate an understanding of the present invention, description will at first be made about conventional antennas with reference to FIGS. 1 and 2.

Referring to FIG. 1, a process of producing a conventional helical antenna will be described. At first, an antenna base element is prepared. The antenna base element has one-end portion provided with a helical coil guide 11 made of a nonconductive material such as nylon and the other-end portion coupled to a sleeve 5 made of a conductive material. The sleeve 5 has a sleeve-helical coupling portion 6 and a flange portion and serves as a feeding portion. Then, a helical antenna element 40 of a helical shape is screwed onto the helical coil guide 11 and is brought into contact with the flange portion of the sleeve 5. The helical antenna element 40 is electrically fed through the sleeve 5 to have an antenna function. Finally, in order to protect the helical antenna element 40 and to improve a commercial value in design, an antenna top (not shown) is molded to cover the one-end portion of the antenna base element and the flange portion of the sleeve. Thus, the helical antenna is completed.

Referring to FIG. 2, a process of producing a conventional separate antenna will be described. A whip antenna element 9 is mechanically fixed to the other-end portion of the antenna base element before the above-mentioned antenna top is molded. More in detail, the whip antenna element 9 is supported at its one end by an insulator 7 forming a body of the antenna base element and extending through an inner bore of the sleeve 5. The helical antenna element 40 is screwed onto the helical coil guide 11 and is brought into contact with the flange portion of the sleeve 5 so as to be electrically fed from the sleeve 5. Thereafter, the antenna top 10 is molded to cover the one-end portion of the antenna base element and the flange portion. Subsequently, the whip antenna element 9 is covered with a face tube 8 for protection and smart appearance. Around the face tube 8, a holder (not shown) is attached so as to be slidable on the outer peripheral surface of the face tube 8. A stopper (not shown) is attached to the whip antenna element 9 at the other end thereof opposite to the one end fixed to the insulator 7. Thus, the separate antenna is completed. It is noted here that the holder serves to attach the antenna to a housing of a radio apparatus. When the antenna is extended, the stopper is engaged with the holder to maintain an extended condition of the antenna. The antenna top 10 may be replaced by an antenna cap preliminary formed so as to achieve a similar function. In this event, the cap is simply fitted to cover the antenna base element.

Upon manufacture of the helical antenna or the separate antenna described above, it is required to screw the helical antenna element 40 of a predetermined diameter (for example, $\phi$=0.5 mm) onto the helical coil guide 11. During any operation in the overall manufacturing process up to the formation of the antenna top 10 or the fitting of the antenna cap, the helical antenna element 40 may be deformed or displaced under some external force. Specifically, the helical antenna element 40 is often deformed or displaced under the pressure of molded resin during the formation of the antenna top 10. In this event, antenna characteristics will be adversely affected.

In order to avoid the above-mentioned situation, the size of each of the helical antenna element 40 and the helical coil guide 11 is accurately selected so that the helical antenna element 40 is exactly fitted to the helical coil guide 11 to be prevented from easy movement out of its proper position.

However, in order to fit the helical antenna element 40 of such a size accurately selected as described above to the helical coil guide 11, delicate and skillful work is required. In addition, it is difficult to completely prevent the deformation or the displacement of the helical antenna element 40. As a result, the production cost is inevitably increased in order to provide good products excellent in antenna characteristics and high in reliability.

Now, description will be made in detail about one embodiment of the present invention with reference to FIGS. 3–6.

An antenna according to one embodiment of this invention comprises an antenna base element having one-end portion arranged in an antenna top and the other-end portion fitted and connected to a part of a sleeve as a feeding portion, like in the conventional antenna described above. As a characteristic of this invention, the antenna base element comprises a flexible substrate 1.

Figure 3:
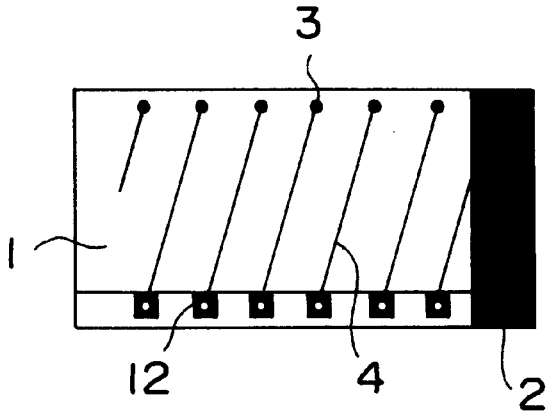
FIG. 3 is a plan view of a flexible substrate to form an antenna base element of an antenna according to one embodiment of this invention.

Referring to FIG. 3, the flexible substrate 1 is provided with a plurality of oblique conductive patterns 4 printed thereon. The oblique conductive patterns 4 have a same width and extend from one side to the other side of the flexible substrate 1 in parallel to one another at a same pitch. The flexible substrate 1 has a plurality of contact pin terminals 3 formed at one ends of the oblique conductive patterns 4 on the one side of the flexible substrate 1 and a plurality of contact receptacle terminals 12 formed at the other ends of the oblique conductive patterns 4 on the other side of the flexible substrate 1. Furthermore, the flexible substrate 1 is provided with a feeding contact 2 formed on one of two remaining sides thereof to be electrically connected to the sleeve 5 when the antenna base element is fitted and bonded to the above-mentioned part of the sleeve 5.

Figure 4:
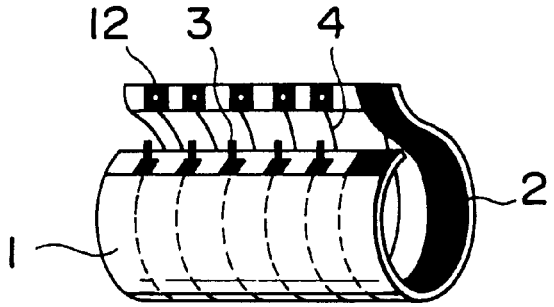
FIG. 4 is a perspective view of the flexible substrate illustrated in FIG. 3 when it is rounded in a cylindrical shape.

Referring to FIG. 4, the flexible substrate 1 illustrated in FIG. 3 is rounded to form a cylindrical shape. The one side and the side of the flexible substrate 1 are fixedly bonded to each other by soldering or welding to form the antenna base element. In this state, the contact pin terminals 3 and the contact receptacle terminals 12 of the flexible substrate 1 are connected to each other in one-to-one correspondence. As a result, a combination of the oblique conductive patterns 4 extends along a helical shape and forms a helical conductive pattern having an antenna function similar to the helical antenna element 40 of the antenna illustrated in FIG. 2.

Figure 5:
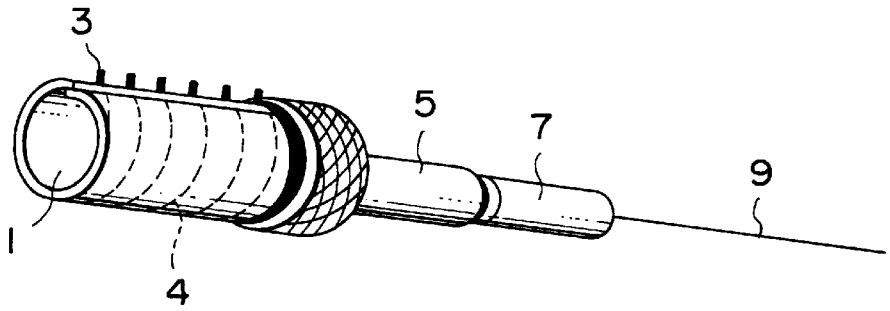
FIG. 5 is a perspective view of a separate antenna comprising the antenna base element with the flexible substrate in FIG. 4 connected to a part of a sleeve.

Referring to FIG. 5, a separate antenna comprises the antenna base element with the feeding contact 2 of the flexible substrate 1 connected to a part of the sleeve 5 (specifically, a sleeve-helical coupling portion 6 described in conjunction with FIGS. 1 and 2). At the other end of the antenna base element, a whip antenna element 9 is mechanically fixed by the insulator 7 that extends through the sleeve 5 fitted thereto.

Figure 6:
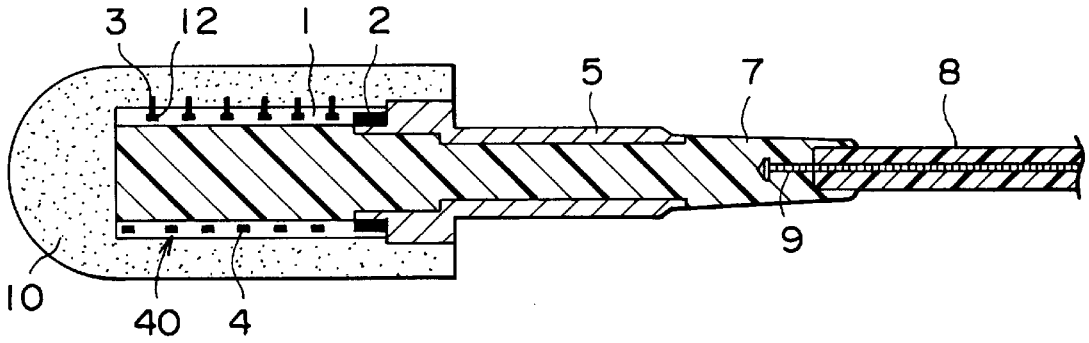
FIG. 6 is a side sectional view of the separate antenna illustrated in FIG. 5.

Referring to FIG. 6, an antenna top 10 is formed to cover the one-end portion of the antenna base element and the flange portion of the sleeve 5. Then, a face tube 8 for protection and smart appearance is attached to cover the whip antenna element 9 coupled to the other end of the insulator 7. Thus, the separate antenna is completed.

In the separate antenna of the above-mentioned structure, the flexible substrate 1 as the antenna base element of a flexible structure has the oblique conductive patterns 4 forming the helical conductive pattern equivalent in function to the helical antenna element of the conventional antenna. Therefore, manufacture or assembling is easily carried out without deformation or displacement of the helical conductive pattern which is printed on the flexible substrate 1. As a result, stable electrical characteristics are achieved.

In the foregoing, embodiment, the contact pin terminals 3 protrude outwards in a radial direction when the flexible substrate 1 is rounded and bonded. Alternatively, the contact pin terminals 3 may protrude inwards provided that a plurality of pin escape grooves are formed in the insulator 7 to serve as helical guides for the contact pin terminals 3. In this event, coupling between the contact pin terminals 3 and the pin escape grooves prevents the rotation of the flexible substrate 1 so that antenna characteristics are further stabilized.

In the foregoing, description has been directed to a separate antenna. It is noted here that this invention is also applicable to an integral-type antenna (wherein each of the helical antenna, the sleeve 5, and the whip antenna element 9 are electrically connected) and a fixed antenna wherein (only the helical antenna exhibits the antenna function) to achieve a similar effect. In any event, the helical antenna is achieved by the helical conductive pattern formed by a combination of the oblique conductive patterns 4.

As described above, in the antenna of this invention, the antenna base element has a flexible structure achieved by the flexible substrate 1. The flexible substrate 1 is rounded in a cylindrical shape so that the oblique conductive patterns 4 printed thereon are combined and electrically connected to form the helical conductive pattern equivalent to the helical antenna element 40 in the conventional antenna. Thus, the antenna can be easily and economically assembled and manufactured without displacement or deformation and is therefore stable in electrical characteristics and high in reliability.

What is claimed is:

1. An antenna for use in a mobile communication apparatus, comprising:

a helical antenna element of a helical shape; and a flat flexible substrate that is adapted to be rounded to form a cylindrical shape; and a conductive sleeve that acts as an electrical feeding portion to said flat flexible substrate;

wherein said helical antenna element comprises a plurality of oblique conductive patterns which extend between lateral end portions of said flat flexible substrate and which are electrically connected to one another at their terminal ends to form said helical shape when said flat flexible substrate is rounded to form the cylindrical shape, said oblique conductive patterns having a similar pitch therebetween, and wherein said flat flexible substrate comprises a feeding element formed at a longitudinal end portion thereof, said feeding element being adapted to be fitted around and electrically connected to an end portion of said conductive sleeve when said flat flexible substrate is rounded to form the cylindrical shape.

2. An antenna as claimed in claim 1, wherein said oblique conductive patterns are parallel to one another.

3. An antenna as claimed in claim 1, wherein said oblique conductive patterns have a width similar to one another.

4. An antenna as claimed in claim 1, further comprising an antenna top adapted to contain said flat flexible substrate when said flat flexible substrate is rounded to form the cylindrical shape.

5. An antenna as claimed in claim 1, wherein said helical element further comprises a plurality of contact pin terminals connected to first ends of said oblique conductive patterns and a plurality of contact receptacle terminals connected to second ends of said oblique conductive patterns, said contact pin terminals and said contact receptacle terminals being adapted to be self coupling with each other in one-to-one correspondence when said flat flexible subtrate is rounded to form the cylindrical shape.

* * * * *